US006626009B1

(12) United States Patent
Ohlund

(10) Patent No.: US 6,626,009 B1
(45) **Date of Patent: *Sep. 30, 2003**

(54) REVERSIBLE JEWELRY FASTENER PERMITTING SELECTIVE ILLUMINATION

(75) Inventor: Stephen K. Ohlund, San Luis Obispo, CA (US)

(73) Assignee: Calypso Worldwide Marketing, Inc. (BS)

( * ) Notice: Subject to any disclaimer, the term of this patent is extended or adjusted under 35 U.S.C. 154(b) by 245 days.

This patent is subject to a terminal disclaimer.

(21) Appl. No.: 09/666,022

(22) Filed: Sep. 19, 2000

Related U.S. Application Data

(63) Continuation-in-part of application No. 09/229,728, filed on Jan. 13, 1999, now Pat. No. 6,233,971, which is a continuation-in-part of application No. 09/134,189, filed on Aug. 14, 1998, now Pat. No. 6,122,933.

(51) Int. Cl.[7] ..... A44C 5/00

(52) U.S. Cl. ..... 63/3.1; 63/3; 362/104; 439/37; 439/218; 429/96; 429/100; 24/614; 24/616

(58) Field of Search ..... 63/3, 3.1; 362/104; 439/37, 218, 354, 500, 930; 429/96, 98, 100; 24/614, 615, 616

(56) References Cited

U.S. PATENT DOCUMENTS

| | | | | |
|---|---|---|---|---|
| 476,080 A | | 5/1892 | Sanche | 439/794 |
| 1,771,710 A | | 7/1930 | Gover | 40/540 |
| 1,951,259 A | | 3/1934 | Ryalls | 439/726 |
| 2,056,248 A | | 10/1936 | Buchanan | 439/784 |
| 2,615,227 A | | 10/1952 | Hornik | 24/303 |
| 2,931,009 A | | 3/1960 | Dutton et al. | 439/805 |
| 3,010,747 A | | 11/1961 | Bondon | 287/116 |
| 3,254,323 A | | 5/1966 | Wyse | 439/457 |
| 3,383,503 A | | 5/1968 | Montgomery | 362/104 |
| 3,670,297 A | | 6/1972 | Erlenbach | 339/232 |
| 3,689,758 A | | 9/1972 | Power | 362/104 |
| 3,790,920 A | | 2/1974 | Wening | 339/116 |
| 3,810,258 A | | 5/1974 | Mathauser | 339/12 |
| 3,829,332 A | | 8/1974 | Iizuka et al. | 429/97 |
| 3,968,357 A | | 7/1976 | Hamilton | 240/6.4 |
| 3,984,674 A | | 10/1976 | Guetta | 240/6.4 |
| 4,076,976 A | | 2/1978 | Fenton | 362/104 |
| 4,093,973 A | | 6/1978 | Vaagenes | 362/104 |
| 4,096,552 A | | 6/1978 | Ben-Porat | 362/104 |
| 4,112,941 A | | 9/1978 | Larimore | 128/2.06 |
| 4,156,552 A | | 5/1979 | Wilson et al. | 339/29 |
| 4,173,229 A | | 11/1979 | Halfon | 63/1.1 |
| 4,262,324 A | * | 4/1981 | Murphy | 362/104 |
| 4,271,457 A | | 6/1981 | Martin | 362/104 |
| 4,296,459 A | | 10/1981 | DeLuca | 362/104 |
| 4,298,917 A | | 11/1981 | Ware | 362/103 |

(List continued on next page.)

FOREIGN PATENT DOCUMENTS

| | | | |
|---|---|---|---|
| DE | 2827886 | 1/1980 | 362/104 |
| FR | 35379 | 3/1930 | 439/805 |
| FR | 2315237 | 1/1977 | 63/1.1 |
| FR | 2347607 | 4/1977 | 362/104 |

*Primary Examiner*—J. J. Swann
*Assistant Examiner*—Andrea Chop
(74) *Attorney, Agent, or Firm*—Holland & Knight LLP

(57) ABSTRACT

Illuminated jewelry having a fastening mechanism that allows illuminated jewelry to be worn in either an energized or de-energized state. In the preferred embodiment, the jewelry takes the form of a necklace with an illuminated pendant. First and second electrical leads allow the necklace to be worn around the neck of a user. Each of the leads includes a connector at its distal end. Preferably, the connectors are electrical connectors with two coupling orientations. In the first orientation, the circuit is energized and illuminated. In the second orientation, the circuit is de-energized and not illuminated. Thus, the necklace can be worn around a user's neck in either an illuminated or non-illuminated state.

9 Claims, 5 Drawing Sheets

U.S. PATENT DOCUMENTS

| | | | | | |
|---|---|---|---|---|---|
| 4,309,743 | A | | 1/1982 | Martin | 362/104 |
| 4,317,969 | A | | 3/1982 | Reigler et al. | |
| 4,459,645 | A | | 7/1984 | Glatter | 362/104 |
| 4,609,238 | A | | 9/1986 | Jamgotchian | 339/12 |
| 4,719,544 | A | | 1/1988 | Smith | 362/104 |
| 4,779,172 | A | | 10/1988 | Jiminez et al. | 362/104 |
| 4,894,757 | A | | 1/1990 | Frusha et al. | 362/104 |
| 4,942,744 | A | | 7/1990 | Wei | 63/1.1 |
| 4,985,922 | A | | 1/1991 | Kolbert | 380/59 |
| 5,018,053 | A | | 5/1991 | Belknap et al. | 362/104 |
| 5,066,905 | A | | 11/1991 | Betton et al. | 324/133 |
| 5,231,740 | A | * | 8/1993 | Mohebkhosravi | 24/616 |
| 5,253,149 | A | | 10/1993 | Ostema et al. | 362/104 |
| 5,268,826 | A | | 12/1993 | Greene | 362/103 |
| 5,367,891 | A | | 11/1994 | Furuyama | 63/29.2 |
| 5,401,175 | A | | 3/1995 | Guimond et al. | 439/38 |
| 5,477,433 | A | | 12/1995 | Ohlund | 362/104 |
| 5,622,062 | A | | 4/1997 | Gong-Hwa | 63/15 |
| 5,653,530 | A | | 8/1997 | Pittman | 362/307 |
| 5,690,412 | A | | 11/1997 | Sheldon | 362/104 |
| 5,722,260 | A | | 3/1998 | Mangano | 63/3.1 |
| 5,772,473 | A | | 6/1998 | Cheng et al. | 439/621 |
| 5,779,487 | A | | 7/1998 | Gatin | 439/39 |
| 5,836,670 | A | | 11/1998 | Gilson | 362/103 |
| 5,843,595 | A | * | 12/1998 | Kawakatsu | 429/97 |
| 5,876,109 | A | | 3/1999 | Scalco | 362/104 |
| 6,087,037 | A | * | 7/2000 | Rieder | 429/99 |
| 6,122,933 | A | | 9/2000 | Ohlund | 63/3 |
| 6,227,896 | B1 | * | 5/2001 | Chang | 439/354 |
| 6,233,971 | B1 | * | 5/2001 | Ohlund | 63/3 |
| 6,241,558 | B1 | * | 6/2001 | Mosquera | 439/660 |

* cited by examiner

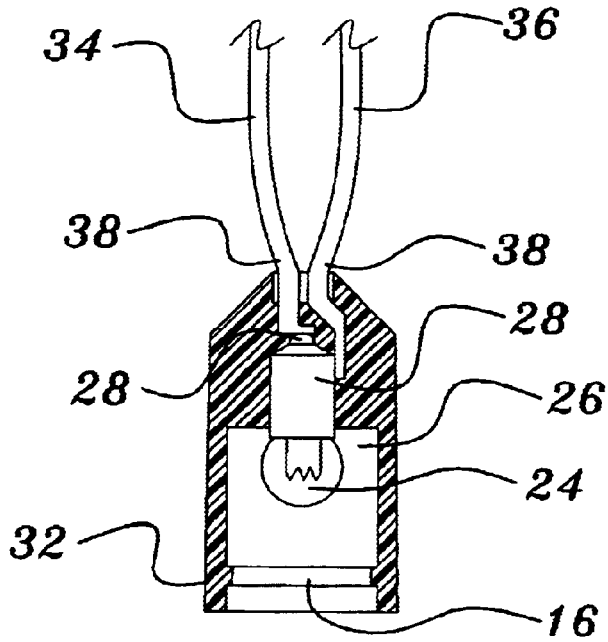
FIG. 5
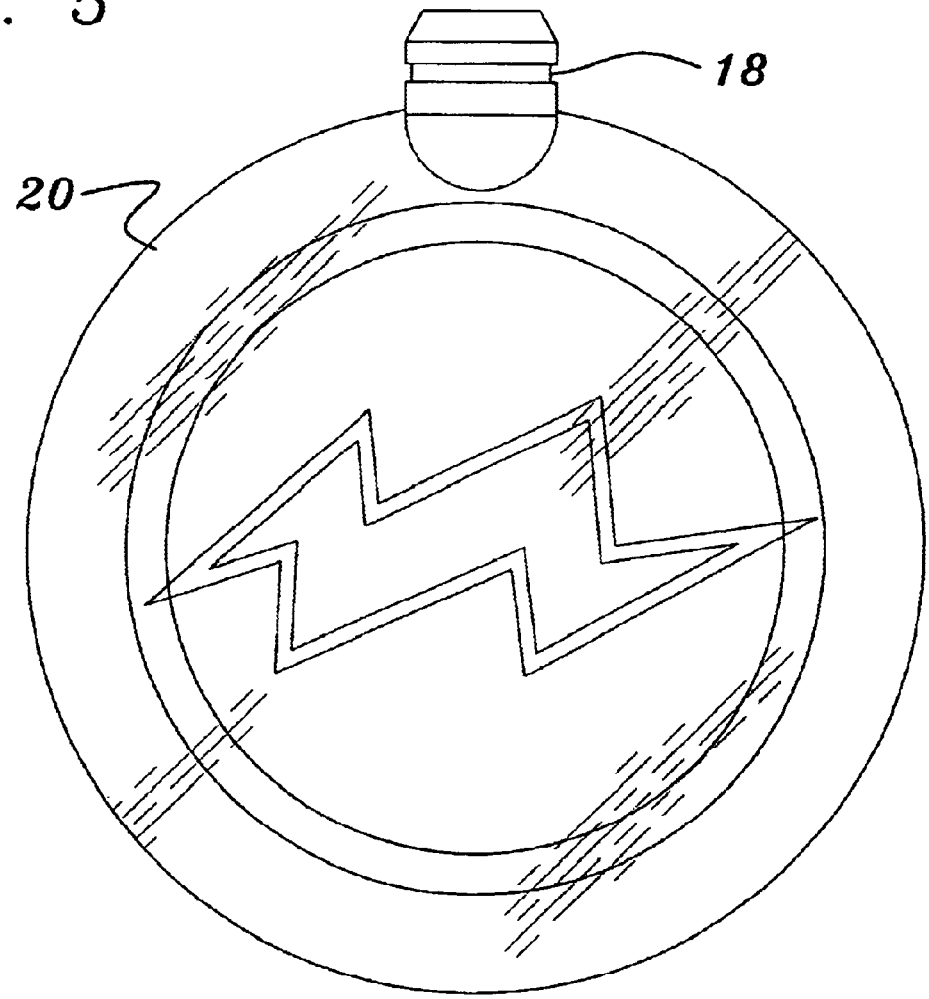

REVERSIBLE JEWELRY FASTENER PERMITTING SELECTIVE ILLUMINATION

RELATED APPLICATION DATA

The present application is a Continuation-in-Part of application Ser. No. 09/229,728 filed Jan. 13, 1999, now U.S. Pat. No. 6,233,971 which is a Continuation-in-Part of application Ser. No. 09/134,189 filed Aug. 14, 1998, now U.S. Pat. No. 6,122,933. Both of these related applications are incorporated herein by reference and made part of this application.

BACKGROUND OF THE INVENTION

1. Field of the Invention

The present invention relates to illuminated jewelry and, more particularly, to a reversible fastener that permits the jewelry to be selectively illuminated depending upon the fastener orientation.

2. Description of the Background Art

Illuminated jewelry is known in the art. Typically, the illumination is achieved by incorporating a small lighting element and power source into an otherwise ordinary piece of jewelry. The effect, however, is anything but ordinary. Daytime use of illuminated jewelry creates a unique visual appearance and draws attention to both the ornament and its wearer. The effect is even more dramatic during evening hours or in dimly lighted environments. Different colors can be selected to generate an even more unique visual appearance.

An example of illuminated jewelry is provided in U.S. Pat. No. 4,262,324 to Murphy. Murphy discloses a necklace with a pendant and a power pack. The pendant houses an incandescent lamp and the power pack houses a dry cell battery. The lamp may be selectively illuminated by either taking apart the battery holder or by operating a switch.

Additional illuminated jewelry is illustrated in this inventor's prior patent, U.S. Pat. No. 5,477,433. Ohlund discloses a necklace including a pendant, an illuminated element (such as a lamp or L.E.D), and a power source. The necklace also includes mutually engagable and alternately disengagable clasp elements for placing the necklace around, and alternately removing the necklace from, a person's neck.

U.S. Pat. No. 5,722,260 to Mangano discloses a reversible jewelry clasp for necklaces. The clasp includes a pair of clamshell-like halves pivotally joined together. The ends of a necklace can be attached to hooks mounted on the inner side of one of the halves. Thereafter, the halves can be closed to secure the necklace. The clasp has a decorative front and back such that it can be flipped without losing its stylized look.

Although each of the above described jewelry articles achieves its individual objective, none of the articles employs a reversible fastener that allows for the selective illumination of jewelry. More specifically, none of the above described jewelry articles allows its user to easily and efficiently wear the article in either an illuminated or non illuminated state.

Therefore, it is an object of the present invention to provide an improvement, which overcomes the aforementioned inadequacies of the prior art devices and provides a significant contribution to the advancement of jewelry fasteners.

Another object of the present invention is to provide an article of jewelry that can be efficiently and easily worn in either an illuminated or non illuminated state.

An additional object of the present invention is to enable illuminated jewelry to be turned off without the use of an electrical switch or without requiring that the jewelry be removed.

Still another object of the present invention is to utilize a jewelry fastener as both a mechanical coupling and an electrical connector.

Still yet another object of the present invention is to provide an illuminated jewelry piece that stores one or more batteries within one of its fastening elements.

Yet another object of the present invention is to provide an article of jewelry with an electrically conductive band that acts both as a means for mechanically securing the batteries and as an electrical conductor.

A still further object of the present invention is to provide a necklace capable of selective illumination. The necklace includes an ornament to which is connected an illumination source capable of directing light into the ornament. Power is delivered to the illumination source by way of electrical contacts and first and second electrical leads. The first and second leads have distal ends to which are connected a female and male electrical connector, respectively. The female electrical connector has opposing major faces and peripheral sidewalls therebetween. The connector is further defined by a rectangular body, an opened second end, and an internal cavity. The male electrical connector is defined by first and second ends, and first and second opposing major faces with peripheral sidewalls therebetween. A battery is removably secured within the male connector. The distal end of the second electrical lead is interconnected to the first end of the male connector and is in electrical communication with the battery. The male and female connectors are adapted to be mechanically coupled in one of two orientations. The first coupling orientation completes a circuit between the first lead, the contacts of the illumination source, the second lead, and the battery to illuminate the ornament. The second coupling orientation de-energizes the circuit.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, the invention relates to a necklace capable of selective illumination. The necklace includes a translucent ornament, which can exhibit a design or surface indicia. The ornament is lit by way of an interconnected illumination source. This illumination source has electrical contacts and first and second electrical leads that allow for the delivery of electrical power.

Electrical connectors are formed at the distal ends of the electrical leads and serve as a means for both mechanical and electrical coupling. A male connector is formed at the end of the second lead, and a female connector is formed at the end of the first lead. The female electrical connector is defined by opposing major faces, peripheral sidewalls, and a first tapered end formed about an aperture. The female connector is further defined by an opened second end and a rectangular internal cavity into which the male connector is adapted to be inserted. The first lead is interconnected to the female connector through the aperture, with the aperture being formed adjacent one of the major faces of the connector. Additionally, first and second openings are formed through the peripheral sidewalls adjacent the opening of the female connector. These openings are employed in connecting the male and female connectors.

The male electrical connector is defined by first and second ends, opposing major faces, and peripheral sidewalls. A battery is positioned within the connector and is secured by a removable band. An arcuate opening is formed through the peripheral wall of the second end adjacent to one of the major faces. The opening exposes the battery for the purpose of completing the circuit. The distal end of the second electrical lead is interconnected to the first end of male connector and is in electrical communication with the battery. A channel is formed within the first end and defines a resilient catch with a detent formed thereon. The detent is adapted to be selectively received within either the first or second rectangular openings of the female connector to thereby mechanically couple the male and female connectors. With the detent in the first opening, the battery is placed in electrical communication with the first lead to complete a circuit and illuminate the ornament. Alternatively, when the detent is in the second aperture, the battery is isolated from the first electrical lead and the circuit is de-energized.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 5 is a view of the ornament detached from the housing.

Similar reference characters refer to similar parts throughout the several views of the drawings.

DETAILED DESCRIPTION OF THE PREFERRED EMBODIMENT

The present invention relates to illuminated jewelry. More specifically, the present invention relates to a fastening mechanism that allows illuminated jewelry to be worn in either an energized or de-energized state. In the preferred embodiment, the jewelry takes the form of a necklace with an illuminated pendant. First and second electrical leads allow the necklace to be worn around the neck of a user. Each of the leads includes an electrical connector at its distal end. Preferably, the connectors are electrical connectors with two coupling orientations. In the first orientation, the circuit is energized and illuminated. In the second orientation, the circuit is de-energized and not illuminated. The various components of the present invention, and the manner in which they interrelate, will be described in greater detail hereinafter.

Figure 1:
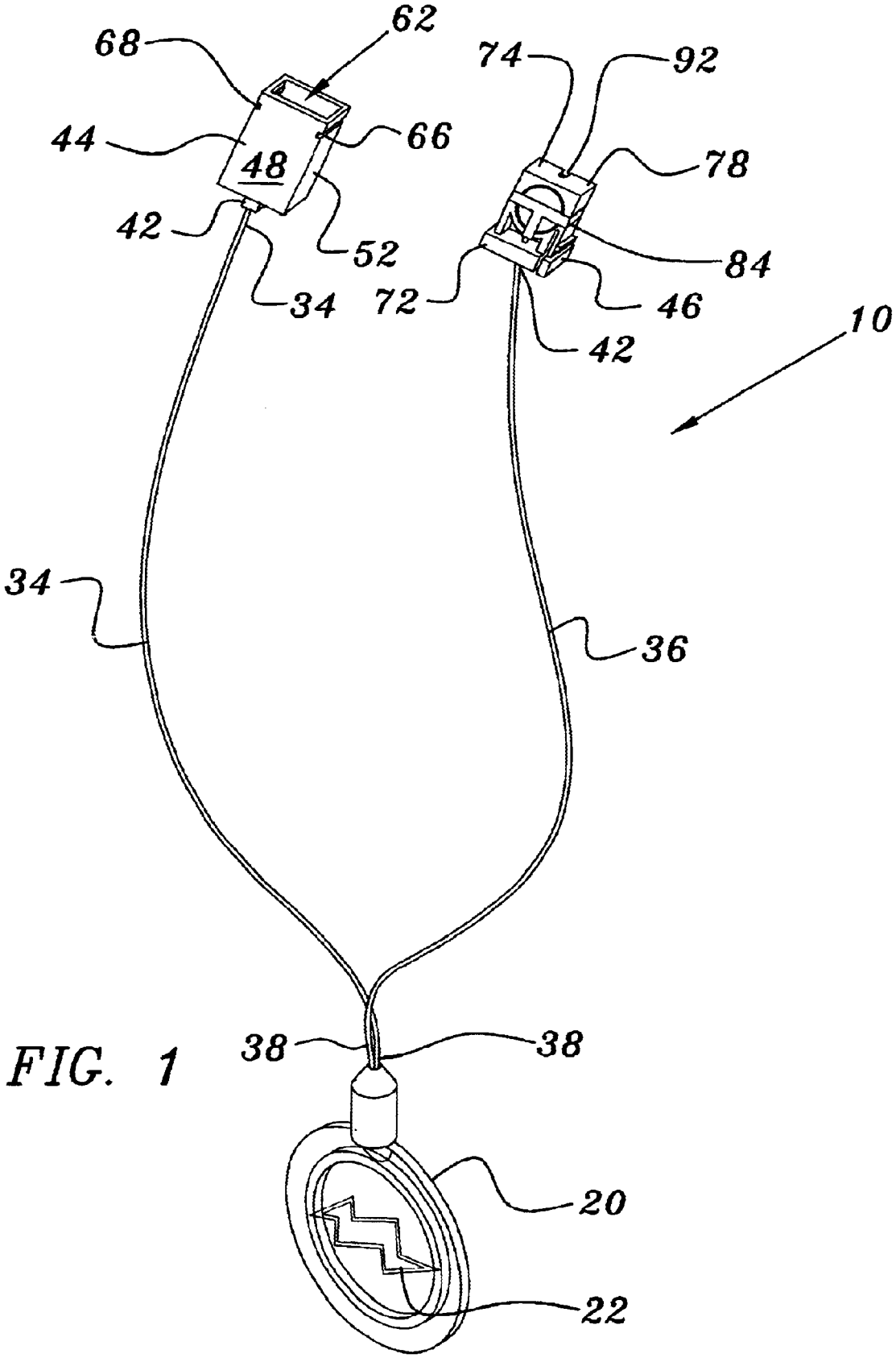
FIG. 1 is a perspective view of the necklace of the present invention.
Figure 2:
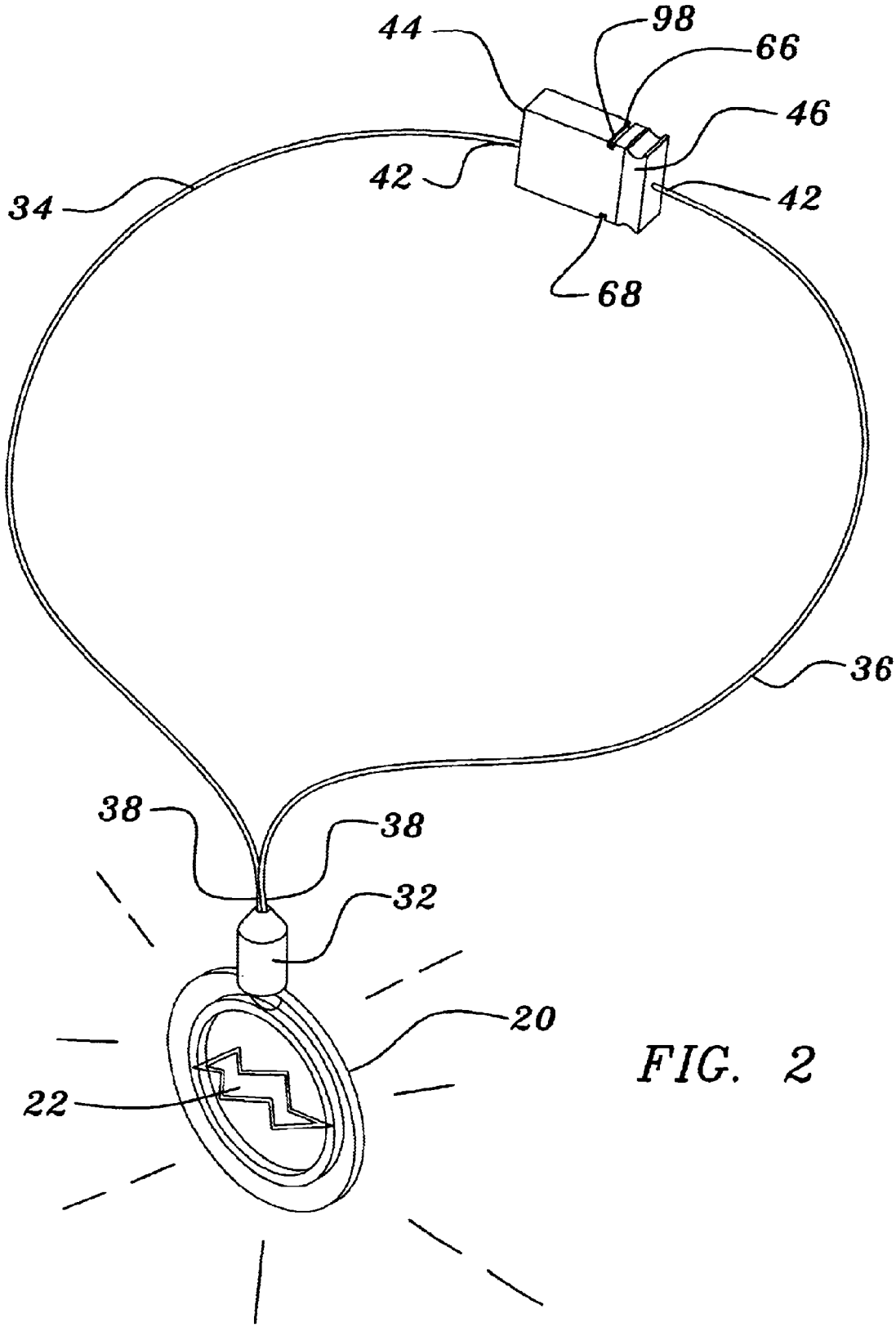
FIG. 2 is a perspective view of the necklace with the male and female connectors coupled with one another.

With reference now to FIG. 1, the necklace 10 is shown in its entirety and in its uncoupled state, for example, prior to being placed around the neck of a wearer. The ornament 20 represents one of the major necklace components. In the preferred embodiment, as is more closely illustrated in FIG. 3, this ornament 20 takes the form of a circular pendant with a surface design or indicia 22. However, it is within the scope of the present invention to utilize different ornaments with the necklace of the present invention. Additionally, it is within the scope of the present invention to employ various other types of designs or indicia beyond the specific design depicted in FIG. 3. The ornament 20 is preferably transparent and constructed from clear plastic. It has been found that by using a transparent ornament unique luminary effects are achieved. Other lighting effects can be achieved by making part of the ornament opaque or by utilizing different translucent colors.

FIG. 5 illustrates the interconnection between the housing 26 and the ornament 20. Specifically, a recess 18 is formed about the upper extent of the ornament 20. A corresponding ridge 16 is formed within the internal wall of the housing 26. The upper extent of the ornament can be inserted within the housing 26 such that the ridge 16 fits into the corresponding recess 18 in a snap fit manner. When so oriented (note FIG. 3) a positive mechanical connection between the ornament 20 and housing 26 is provided. Nonetheless, the connection allows a user to manually separate the ornament 20 from the housing 26. This allows different types of ornaments to be employed with the necklace of the present invention. Consequently, the ornaments themselves can become collector items for use with one necklace arrangement.

Figure 3:
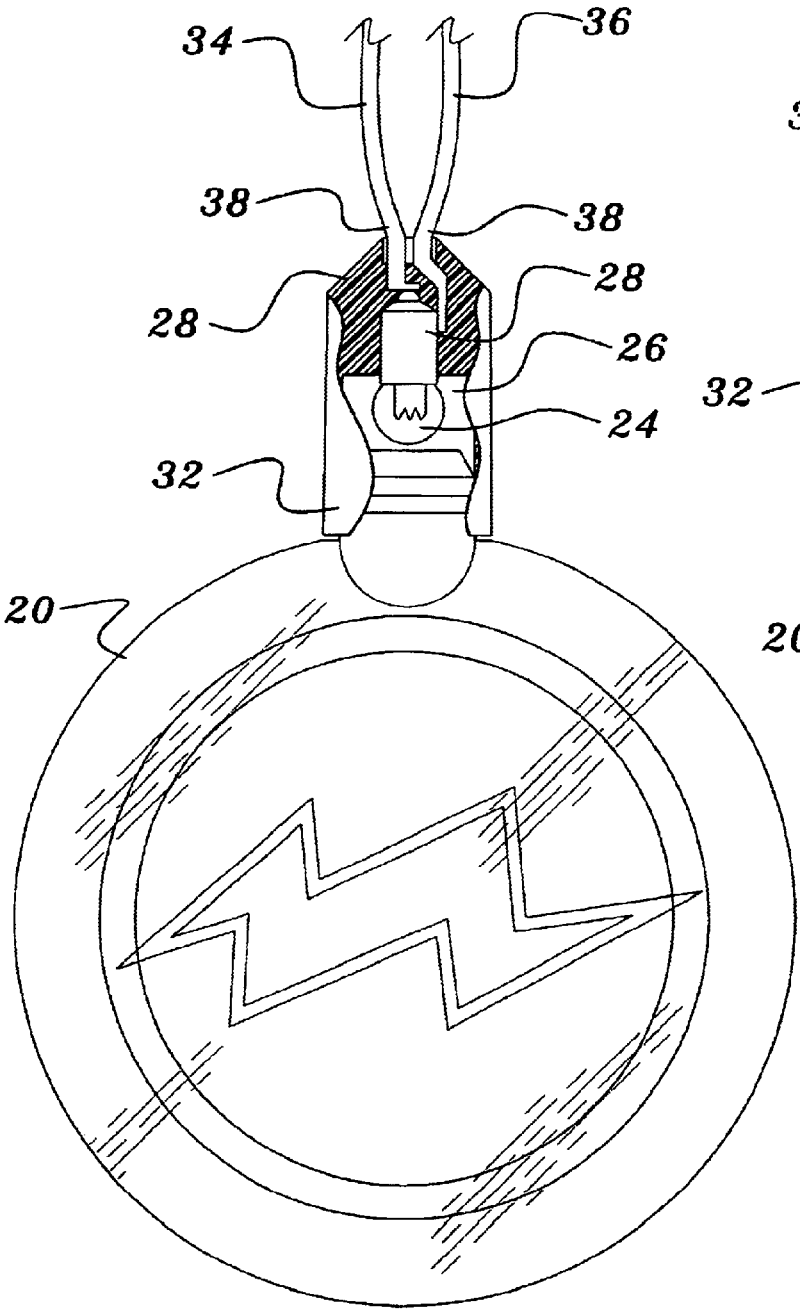
FIG. 3 is a partial sectional view of the ornament and housing.
Figure 4:
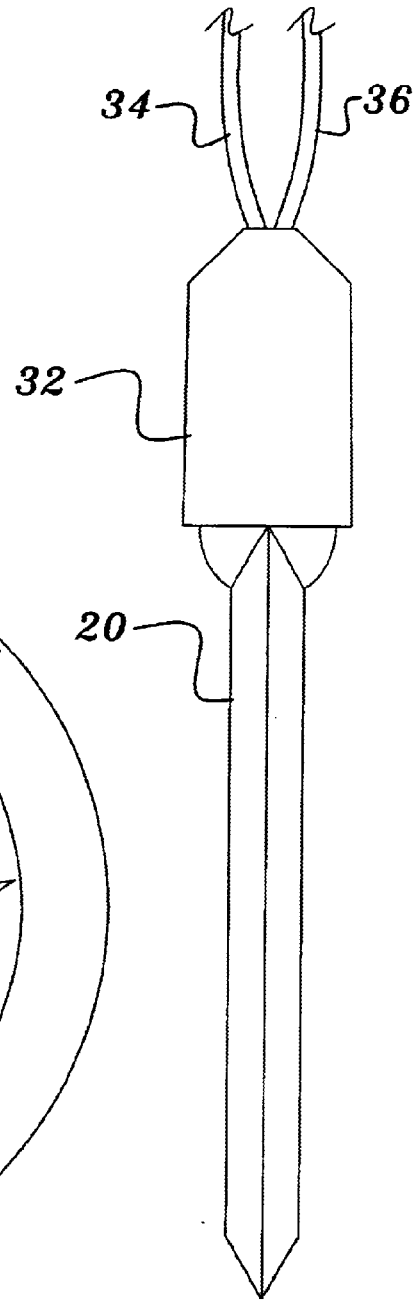
FIG. 4 is a side view of the ornament and housing.

FIG. 3 contains a partial sectional view illustrating the light source 24 employed in the necklace. The light source 24 depicted is a small incandescent lamp which is positioned in a housing 26 immediately above the ornament 20. Other light sources are within the scope of the present invention. For example, the light source may be a light emitting diode. Whichever illumination source is utilized, electrical contacts 28 are provided for delivering electricity to the light source 24 and generating light. A sheath 32 forms part of the housing 26 of the light source 24. As is illustrated, this sheath 32 may be opaque for use in directing light from the lamp into the ornament 20. Alternatively, the sheath 32 may be transparent for use in generating additional unique optical effects. This sheath 32 is employed in both interconnecting the ornament 20 to the housing 26 and protecting the light source 24.

The straps of the necklace are formed from first and second electrical leads, 34 and 36 respectively. The leads, in turn, are formed from insulated metallic wires. Each of these leads has a proximal and distal end (38 and 42, respectively) with the proximal ends 38 of each of the leads being in electrical communication with the electrical contacts 28 of the light source 24. The relationship between the proximal ends 38 of the electrical leads (34 and 36) and the light source 24 is best illustrated with reference to the partial sectional view of FIG. 3. This connection allows electricity to be delivered to the lamp. The surrounding sheath 32 is preferably formed from a non-electrically conducted material, and thus, functions as an insulator.

Figure 6:
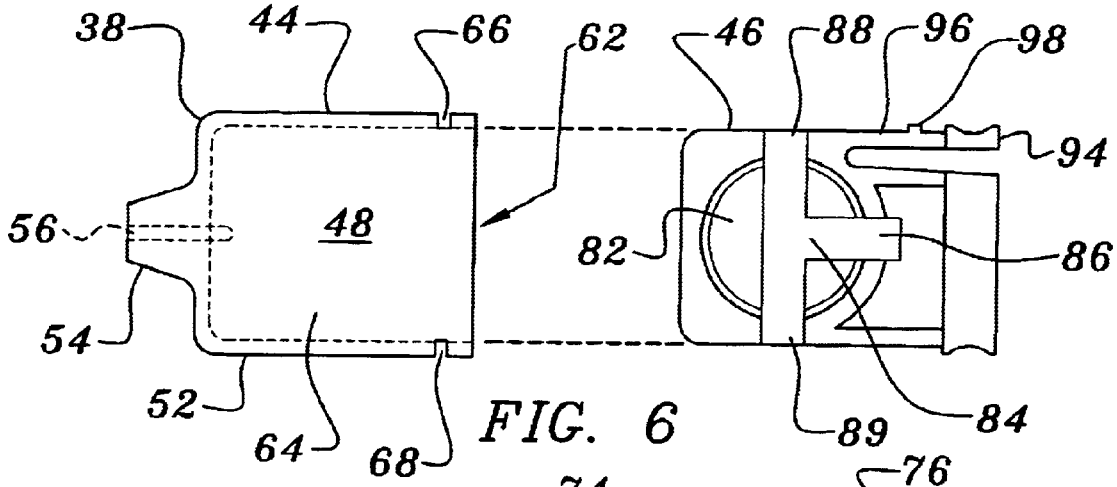
FIG. 6 is a top plan view of the male and female connectors.
Figure 7:
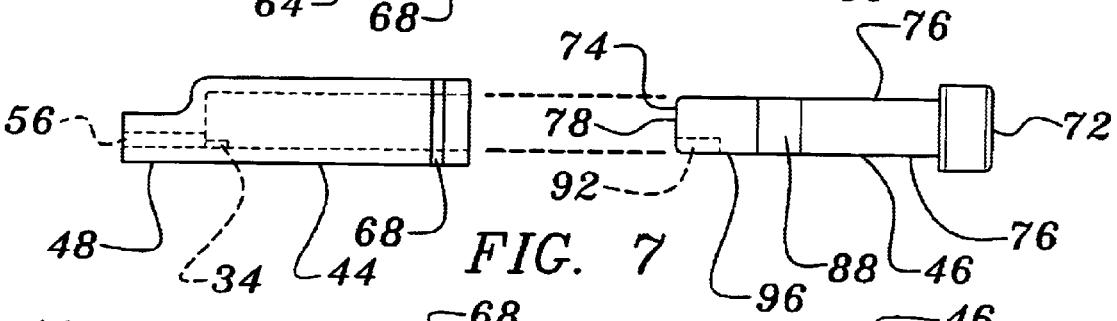
FIG. 7 is a side elevational view of the male and female connectors.
Figure 8:
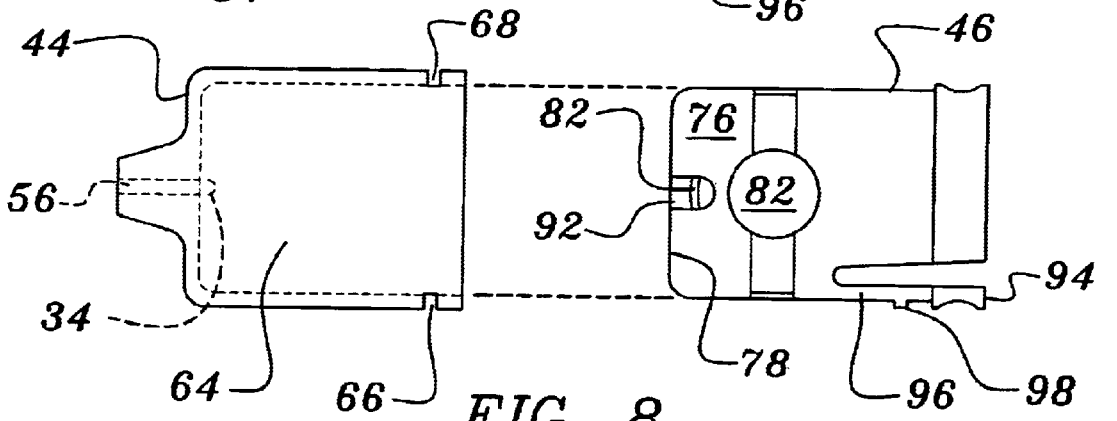
FIG. 8 is a bottom plan view of the male and female connectors.
Figure 9:
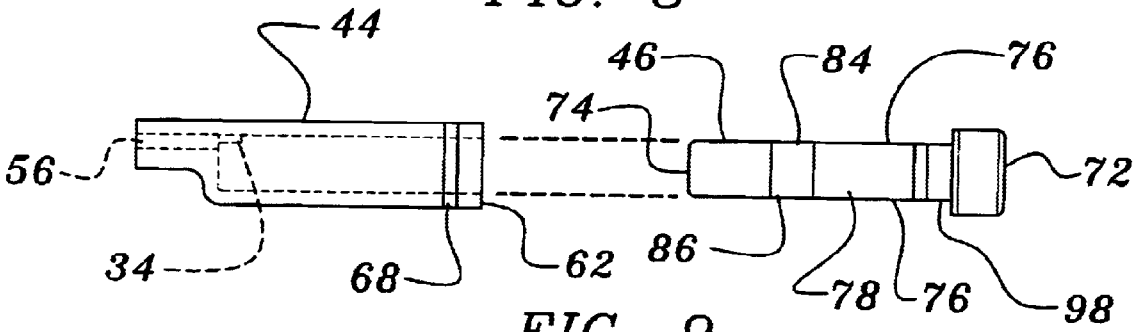
FIG. 9 is a side elevational view of the male and female connectors.

As illustrated in FIG. 1, the first electrical lead 34 includes a female electrical connector 44 formed at its distal end 42. Likewise, the second lead 36 includes a male electrical connector 46 formed at its distal end 42. FIGS. 6–9 are detailed illustrations of the male and female electrical connectors. With reference now to FIGS. 6–9, the female electrical connector 44 will be described. The female connector 44 is defined by opposing major faces 48 and three peripheral sidewalls 52 which extend therebetween. The female connector 44 also includes a first tapered end 54 which is formed about a tubular aperture 56. The function of this tubular aperture 56 will be described in greater detail hereinafter. The female connector 44 is further defined by a rectangular body 58, an open second end 62, and a rectangular internal cavity 64. As can be appreciated, the internal cavity 64 accepts the male connector 46 when the two connectors are coupled. Although the female connector 44 is being described and depicted as rectangular, other connector geometries are within the scope of the present invention. For example, the female connector may be cylindrical in shape. The first lead 34 is connected to the female connector 44 via the tubular aperture 56. The lead 34 extends into the cavity 64 from the aperture 56 and functions in completing an electrical circuit. Moreover, as is clearly illustrated in FIG. 7, the tubular aperture 56 is formed adjacent one of the major faces 48 of the connector 44. In other words, the tubular aperture 56 and lead 34 are offset to one side of the housing 44. The purpose of this offset orientation will be described in greater detail hereinafter. With reference now to FIGS. 6 and 8, the first and second connecting openings (66 and 68, respectively) of the female connector 44 are depicted. These openings take the form of elongated slots, or apertures, which are formed through the peripheral sidewalls 52 of the housing 44 at diametrically opposed locations. These openings (66 and 68) function in interconnecting the male and female connectors (44 and 46) in a manner which will be described more fully hereinafter.

With continuing reference to FIGS. 6–9, the male electrical connector 46 is described. The male connector 46 is defined by first and second ends (72 and 74, respectively) and opposing major faces 76 and peripheral sidewalls 78. As is illustrated, at least one battery 82 is positioned within the connector 46. In the preferred embodiment, two 3 volt batteries are utilized. The batteries are secured within the connector 46 by way of a removable electrically conductive band 84. The band 84 includes three legs. The first base leg 86 is electrically connected to the distal end 42 of the second lead 36. The two remaining legs 88 are removably secured over the peripheral sidewalls 78 of the connector housing. The band 84 has two functions: first, the band 84 secures the battery or batteries 82 within the connector housing; secondly, the band 84 serves in forming an electrical interconnection between the second lead 36 and the negative terminal of the battery 82, with the negative terminal of the battery visible in FIG. 6. Access to the positive terminal of the lower battery is achieved by way of an opening 92 formed within the connector housing. The opening 92 is preferably arcuately shaped and extends along the second end 74 of the peripheral wall 78 and along one of the major faces 76. Thus, in a manner to be described more fully hereinafter, the male and female connectors (44 and 46) can be engaged in such a manner that the opening 92 is aligned with the tubular aperture 56 and lead 34 of the female connector 44. Thus, with the connectors so aligned, the first lead 34 can be brought into electrical communication with the positive terminal of the battery 82. In this orientation, a circuit is completed and the light source 24 is illuminated. Finally, although the batteries have been described as positioned within the male connector, it is within the scope of the present invention to include the batteries within the female connector.

The male and female connectors (44 and 46) are preferably mechanically coupled through a resilient spring biased detent. Specifically, as is illustrated in FIGS. 6 and 8, a channel 94 is formed within the first end 72 of the connector housing. This channel 94 serves to define a resilient catch or arm 96. The arm 96 further includes a detent 98 formed along its length which is specifically sized to fit within either the first or second rectangular opening (66 or 68) of the female connector 44. More specifically, the male connector 46 is inserted into the female connector 44 by resiliently depressing the arm 96 downwardly, thereby allowing the detent 98 to slide into one of the openings (66 or 68). Thereafter, the detent 98 is retained within the opening by the resilient nature of the arm 96. This forms a mechanical connection between the male and female connectors (44 and 46) and prevents inadvertent uncoupling of the necklace 10. Thereafter, the connectors (44 and 46) can be uncoupled by depressing the arm 96 downwardly and pulling the elements apart. By way of this connection, a user may couple the two leads (34 and 36) together about their neck in one of two axially distinct orientations. The first orientation completes an electrical circuit and illuminates the ornament 20. The second orientation de-energizes the circuit and leaves the ornament 20 non-illuminated. In other words, with the detent 98 in the first rectangular opening 66, the axially offset battery opening 92 is placed in electrical communication with the axially offset electrical lead 34 to thereby complete a circuit and illuminate the ornament 20. Alternatively, when the detent 98 is secured within the second aperture 68, the axially offset battery opening 92 is isolated from the axially offset electrical lead 34 and the circuit is de-energized. Thus, a user may secure the necklace about their neck in either an illuminated or non-illuminated state.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A necklace capable of selective illumination comprising:

a translucent ornament having indicia formed thereon;

an illumination source removably interconnected to the ornament and capable of directing light into the ornament, the illumination source having electrical contacts for use in powering the illumination source;

first and second electrical leads each in electrical communication with the contacts of the illumination source, the first and second leads having distal ends;

a female electrical connector having opposing major faces and peripheral sidewalls therebetween, a first tapered end formed about an aperture, a rectangular body, an opened second end, and a rectangular internal cavity, the first lead being interconnected to the female electrical connector through the aperture, the aperture being formed adjacent one of the opposing major faces of the female electrical connector, first and second openings formed through the peripheral sidewalls adjacent the opened second end of the female electrical connector;

a male electrical connector having first and second ends, first and second opposing major faces and peripheral sidewalls therebetween, a battery positioned within the male electrical connector and secured by a removable band, an arcuate opening formed through one of the peripheral sidewalls of the second end, along one of the opposing major faces of the male electrical connector, the arcuate opening exposing the battery, the distal end of the second electrical lead interconnected to the first end of the male electrical connector and in electrical communication with the band and battery, a channel formed within the first end of the male electrical connector and defining a resilient catch with a detent formed thereon, the detent adapted to be selectively received within either the first or second opening of the female electrical connector to thereby mechanically couple the male and female electrical connectors, with the detent in the first opening, the battery is placed in electrical communication with the first lead to complete a circuit and illuminate the ornament, with the detent in the second opening, the battery is isolated from the first electrical lead and the circuit is de-energized.

2. A necklace capable of selective illumination comprising:

an ornament;

an illumination source interconnected to the ornament and capable of directing light into the ornament, the illumination source having electrical contacts for use in powering the illumination source;

first and second electrical leads, each in electrical communication with the contacts of the illumination source, the first and second leads having distal ends;

a female electrical connector having opposing major faces and peripheral sidewalls, and an opened second end, and an internal cavity, a first tapered end formed about an aperture, the aperture being formed adjacent one of the major faces of the female electrical connector, the first lead being interconnected to the female electrical connector by way of the aperture;

a male electrical connector having opposing major faces and peripheral sidewalls, first and second ends and a spring biased detent;

a battery interconnected to the male connector, the distal end of the second electrical lead being interconnected to the first end of the male connector and in electrical communication with the battery;

an opening formed through the peripheral wall of the male electrical connector at the second end of the male electrical connector adjacent one of the major faced of the male electrical connector, the opening functioning to expose the battery; and first and second openings formed through the peripheral sidewalls of the female electrical connector adjacent the opened second end of the female electrical connector, the detent of the male electrical connector adapted to be selectively received within either the first or second opening of the female electrical connector to thereby mechanically couple the male and female connectors in one of two axial orientations, with the detent in the first opening of the female electrical connector, the battery is placed in electrical communication with the first lead to complete a circuit and illuminate the ornament, with the detent in the second opening of the female electrical connector, the battery is isolated from the first electrical lead and the circuit is de-energized.

3. The necklace as described in claim 2 wherein the ornament is translucent and has indicia formed thereon.

4. The necklace as described in claim 2 wherein the battery is positioned within the male electrical connector and is secured by way of a removable band.

5. A fastener for an electrically powered article of jewelry, the fastener comprising:

an ornament;

an illumination source interconnected to the ornament and capable of directing light into the ornament;

a first electrical connector interconnected to a first electrical lead, the first electrical lead also interconnected to the illumination source;

a second electrical connector interconnected to a second electrical lead, the second electrical lead also interconnected to the illumination source;

at least one battery positioned within the second electrical connector;

the first and second connectors capable of interfitting with one another in at least two axially distinct orientations, in a first orientation a circuit is completed between the battery, the first and second electrical leads and the illumination source to thereby light the ornament; in a second orientation the circuit is broken and the illumination source is not lit.

6. The fastener as described in claim 5 wherein the first electrical lead is offset with respect to an axis of the first connector.

7. The fastener as described in claim 5 wherein the ornament is removably interconnected to the illumination source.

8. A reversible fastener for an electrically powered article of jewelry, the fastener comprising:

a female connector interconnected to a first electrical lead;

a male connector interconnected to a second electrical lead;

the male and female connectors capable of mechanical interconnection to complete an electrical circuit and wherein one of the connectors houses at least one battery;

wherein the female connector includes two diametrically opposed elongated openings and wherein the male connector includes a resilient detent which is adapted for selective engagement in one of the two openings of the female connector, thereby allowing the male and female connectors to be mechanically coupled in one of two axially distinct orientations.

9. An electrically powered article of jewelry comprising:

an illumination source;

a translucent ornament detachably coupled to the illumination source such that different ornaments can be used with the jewelry;

a first connector interconnected to a first electrical lead, the first electrical lead also interconnected to the illumination source;

a second connector interconnected to a second electrical lead, the second electrical lead also interconnected to the illumination source;

a battery coupled to one of the electrical leads;

the first and second connectors capable of interfitting with one another in axially discrete orientations, in a first axially discrete orientation a circuit is completed between the battery, and the first and second electrical leads to energize the illumination source and thereby light the ornament; in a second axially discrete orientation the illumination source is de-energized and the ornament is not lit.

* * * * *